US009315022B2

(12) United States Patent
Chang

(10) Patent No.: US 9,315,022 B2
(45) Date of Patent: Apr. 19, 2016

(54) INKJET PRINTING APPARATUS AND PRINTING METHOD

(76) Inventor: Yuan Chang, Newtown Square, PA (US)

( * ) Notice: Subject to any disclaimer, the term of this patent is extended or adjusted under 35 U.S.C. 154(b) by 9 days.

(21) Appl. No.: 13/982,273

(22) PCT Filed: Aug. 1, 2011

(86) PCT No.: PCT/CN2011/077839

§ 371 (c)(1),
(2), (4) Date: Nov. 11, 2014

(87) PCT Pub. No.: WO2013/016860

PCT Pub. Date: Feb. 7, 2013

(65) Prior Publication Data

US 2015/0165765 A1 Jun. 18, 2015

(51) Int. Cl.

| | |
|---|---|
| ***B41J 2/21*** | (2006.01) |
| ***B41J 29/38*** | (2006.01) |
| ***B41J 2/145*** | (2006.01) |
| ***B41J 2/01*** | (2006.01) |
| ***B41J 2/14*** | (2006.01) |
| ***B41J 11/00*** | (2006.01) |

(52) U.S. Cl.

CPC ..... *B41J 2/1433* (2013.01); *B41J 2/145* (2013.01); *B41J 2/21* (2013.01); *B41J 2/2114* (2013.01); *B41J 11/0015* (2013.01)

(58) Field of Classification Search

CPC ..... B41J 2/2114; B41J 2/2117; B41J 11/002; B41J 19/142; B41J 19/147; B41J 2/145; B41J 2/21; B41J 2/1433; B41J 11/0015

USPC ..... 347/9, 12, 14, 40, 43, 100, 102

See application file for complete search history.

(56) References Cited

U.S. PATENT DOCUMENTS

| | | | | |
|---|---|---|---|---|
| 8,215,761 | B2 | 7/2012 | Takezawa et al. | |
| 2004/0252173 | A1 | 12/2004 | Ben-Zur et al. | |
| 2006/0158481 | A1 | 7/2006 | Spevak et al. | |
| 2007/0024686 | A1 | 2/2007 | Kadomatsu et al. | |
| 2007/0097196 | A1 * | 5/2007 | Yoneyama | 347/102 |
| 2009/0244230 | A1 | 10/2009 | Ohnishi et al. | |
| 2010/0194838 | A1 | 8/2010 | Mitsuzawa et al. | |
| 2011/0279504 | A1 * | 11/2011 | Mizes | B41J 3/543 347/14 |
| 2011/0310204 | A1 | 12/2011 | Ohnishi et al. | |

* cited by examiner

*Primary Examiner* — Jannelle M Lebron

(57) ABSTRACT

The present invention relates to an inkjet printing apparatus, includes at least four same-typed print heads, among which, at least two eject ink for coating layer, the rest for colored inks; print heads printing coating layer are interpolated or arranged abreast in a row, and those for colored inks are ranked abreast in another; along printing medium's motion direction, nozzles of print heads ejecting the same colored ink are connected in series. Arranging or interpolating print heads ejecting ink for coating layer in a row and print heads ejecting colored inks arranged abreast in another to make whole printing area covered by coating layer in the present invention, greatly narrow width of print head baseplate, reduce demands on width of UV solidification devices, save cost, and improve operating stability of carriage.

5 Claims, 8 Drawing Sheets

INKJET PRINTING APPARATUS AND PRINTING METHOD

FIELD OF THE INVENTION

The present invention relates to an inkjet printing apparatus and printing method, more specifically, to an colored inkjet printing apparatus, on the precondition of output guaranteed, which can improve quality of printed images, narrow width of print head baseplate; and to its printing method, by which functions of printing white ink, transparent ink or other bottom color inks can be realized.

BACKGROUND OF THE INVENTION

Inkjet is a non-impact dot-matrix printing technology in which droplets of ink are jetted from a small nozzles directly to a specified position on a media to create images or characters. Inks are generally classified into two kinds: inks for coating layer (such as: white ink, transparent ink or other bottom color inks) and colored inks (using for printing images or characters); white ink is generally employed to print background color on non-white printing medium to improve vividness of the printed images, or to print foreground color on transparent printing medium to form reflected images. When printing background images, firstly ejecting white ink on non-white printing medium to form white background, colored images are then printed on the white background, and final images are viewed from the printing side; when printing foreground images, colored images are firstly printed on the transparent printing medium, white ink is then printed on the colored images, and final images are viewed by transmitting the transparent printing medium. Because, colored inks are usually, to some extent, transparent, printing on colored printing medium usually makes the images look like somewhat faded, consequently, a layer of completely opaque white ink is usually printed on the whole printing area of the non-white printing medium, afterwards, printing images on the printing medium already printed by white ink to guarantee brilliance of the images. When printing white ink, in order that white ink evenly covers the whole printing area, demands on print resolution of white ink is high, and its print resolution is usually higher than that of the printed images, such as 1440*1440 dpi. In order to prevent the printed colored images from shedding in prior art or increase the brightness of the printed colored images, a transparent protective layer usually covers the colored images.

In prior art, two sets of UV solidification devices are respectively installed in each side of the carriage; in the course of printing, due to the overlying of bottom color and printed images, when printing images, solidification of ink droplets of the bottom color is necessary, otherwise, ink droplets of different colors would be mixed together, and printing quality be affected. Therefore, width of UV solidification devices must illuminate the whole printing breadth, i.e., width of UV solidification device should be equal to or greater than the total width of the print heads positioned on the carriage's baseplate; while, the wider the area illuminated by the UV solidification devices, the more expensive the UV solidification devices are. As regards to scanning inkjet printing apparatus, in prior art, there are mainly two ways to print white backdrop: in one, white ink is printed firstly, after printing of white ink, printing medium is reversed back, then colored images are printed on the already finished white ink backdrop, arrangement of print heads in this method is shown in FIG. 2, all the print heads are arranged side by side along one axis, in this method, precision of paper feeding direction is not that accurate, printing accuracy of paper feeding direction is hard to be guaranteed, and printing time is accordingly prolonged; in the other method, print heads ejecting white ink and those ejecting colored inks are arranged vertically, print heads ejecting white ink are located at the paper inlet end of the printing medium, printing medium is firstly printed by white ink, then colored images are printed on printing medium already printed by white ink, this method is suitable for printer with relatively few rows of print heads, as shown in FIG. 3, there are two rows of print heads, print head ejecting ink for coating layer in one row, and those ejecting colored inks in the other row, and each print head is specifically for each ink color; in industrial printing, printing output is usually improved by connecting several print heads in series, as in FIG. 4 (where a specific ink is ejected by two print heads), the two print heads ejecting ink for coating layer are connected in series in a row, and print heads ejecting colored inks are connected in series in the other row, relatively large number of print heads leads to the baseplate where print heads are located widened, correspondingly, demands on width of ink solidification devices are also raised, when there are three rows of pint heads in the vertical direction, a UV lamp can illuminate the whole printing area, if there are four rows of print heads in the vertical direction as in FIG. 4, two UV solidification devices or a much wider UV solidification device are (is) needed to illuminate the whole printing area, price of UV solidification device is very expensive and, this makes printing cost greatly increased, meanwhile, motion stability of the carriage during the printing process is also reduced due to widened print head baseplate on which located the print heads.

SUMMARY OF THE INVENTION

The objective of the present invention is to provide a set of colored inkjet printing apparatus which can improve quality of printed images, guarantee printing output, save printing cost and print coating layer and a printing method realized by employing such printing apparatus.

An inkjet printing apparatus in the present invention, wherein, includes at least four same-typed print heads, among which, at least two print heads eject ink for coating layer, the rest to eject colored inks, the print heads ejecting ink for coating layer are interpolated or arranged side by side in a row, and print heads ejecting colored inks are arranged side by side in the other row; along motion direction of the printing medium, nozzles of print heads ejecting the same colored ink are connected in series, and print heads ejecting different colored inks are arranged side by side.

In the foregoing inkjet printing apparatus, the ink for coating layer is white ink.

In the foregoing inkjet printing apparatus, the ink for coating layer is transparent ink.

In the foregoing inkjet printing apparatus, the number of print heads ejecting ink for coating layer may be same as or different from that of print heads ejecting the same colored ink.

In the foregoing inkjet printing apparatus, numbers of pint heads ejecting respective colored ink are same.

An inkjet printing method in the present invention, wherein, including: provides at least four same-typed print heads, among which, at least two print heads eject ink for coating layer, and the rest to eject colored inks; the print heads ejecting ink for coating layer and those ejecting colored inks are in two different rows; the print heads ejecting ink for coating layer are interpolated or arranged side by side; along the printing medium's motion direction, nozzles ejecting the same colored ink in the print heads for colored inks are connected in series, and print heads ejecting different colored inks are ranked side by side; when printing, print heads ejecting ink for coating layer adopt N-pass printing pattern, and print heads ejecting colored inks adopt 2N-pass printing pattern, N is a natural number, greater than zero.

In the foregoing inkjet printing method, when printing, the print heads ejecting ink for coating layer employs two-pass printing pattern, and print heads ejecting colored inks employ four-pass printing pattern.

In the foregoing inkjet printing method, the ink for coating layer is white ink.

In the foregoing inkjet printing method, the ink for coating layer is transparent ink.

Compared with the prior art, the present invention has the following advantages and effects: 1) printings of ink for coating layer and of colored inks are completed in a single paper feeding process, its color register is accurate, and output of inkjet printing is high; 2) in the course of printing, printing resolution of ink for coating layer is higher than that of the printed images, or density of ink for coating layer is higher than that of the printed images so that ink for coating layer covers the whole printing area, and vividness of printed images can be improved; 3) in the course of printing, image printing employs multi-pass printing pattern, which is two times as many as that of the ink for coating layer, with high printing precision, banding problem in one-pass printing can be avoided; 4) in the images, printing accuracy requirements of coating layer are lower than that of colored images, for that reason, in the present invention print heads ejecting ink for coating layer are arranged side by side or interpolated in a row, print heads ejecting respective colored ink are arranged side by side in the other row in order to make ink for coating layer cover the whole printing area, greatly narrow print head baseplate, lower requirements on the width of UV solidification device, reduce carriage's weight, save cost and improve operating stability of the carriage.

DETAILED DESCRIPTION OF THE EMBODIMENTS

The First Embodiment

Figure 1:
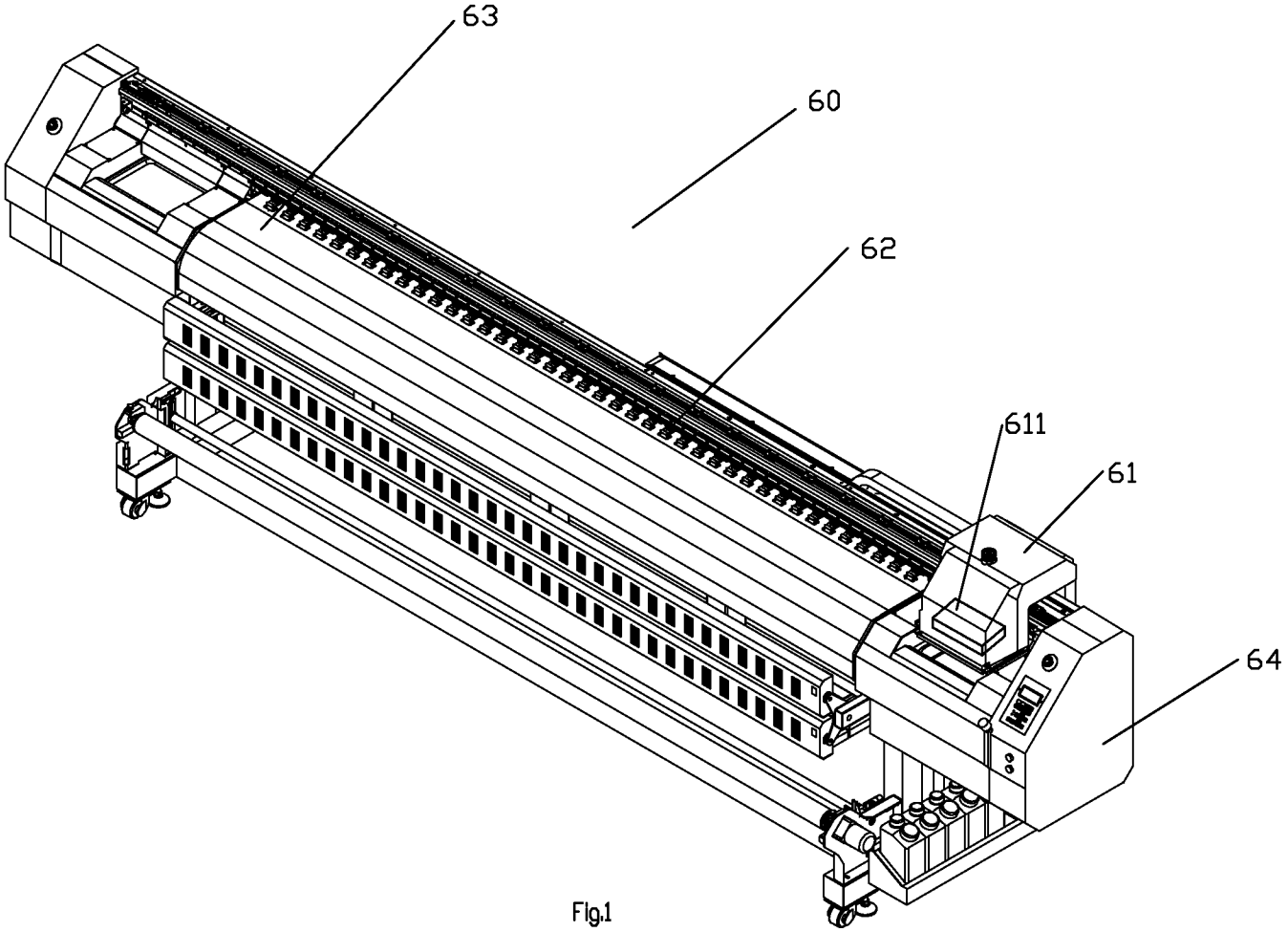
FIG. 1 is a perspective view of inkjet printing apparatus in the present invention.
Figure 2:
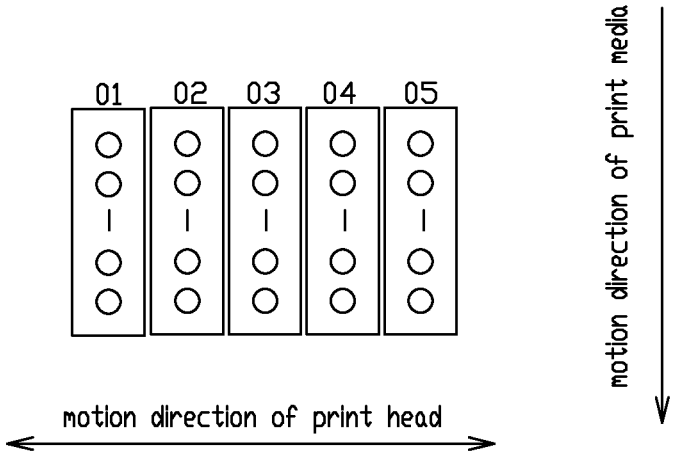
FIG. 2 is schematic diagram of inkjet printing apparatus' print heads in prior art.
Figure 3:
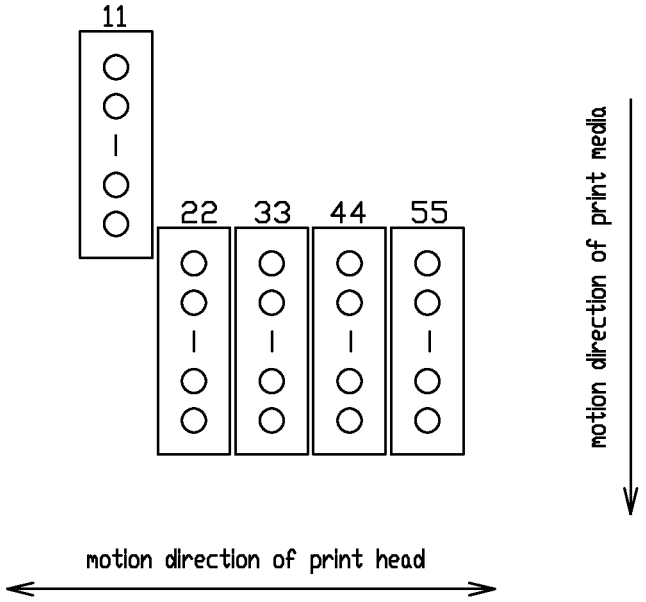
FIG. 3 is another schematic diagram of print heads in prior art, in which the number of print heads ejecting a specific ink is one.
Figure 4:
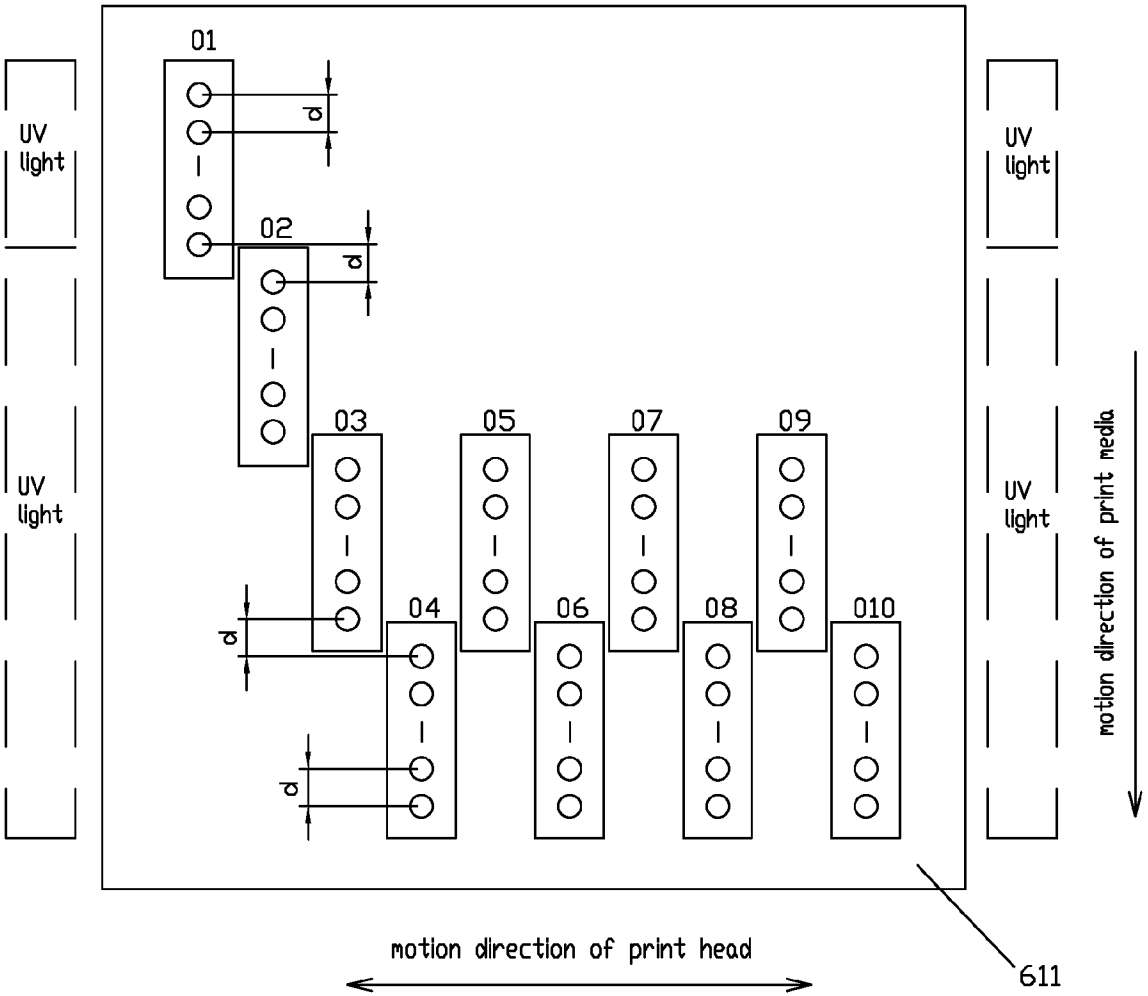
FIG. 4 is schematic diagram of print heads in prior art, in which the number of print heads ejecting a specific ink is two.

Inkjet printing apparatus and printing method in the present embodiment are employed in printing colored images on non-white printing medium. When printing medium is non-white color, a layer of white ink is printed on the printing area of the printing medium to guarantee vividness of the printed images. As in FIG. 1, inkjet printing apparatus 60 in the present embodiment comprises carriage 61, print head baseplate 611, employed to eject ink droplets onto printing medium, is positioned in carriage 61, inkjet printing apparatus 60 in the present embodiment also includes printing platform 63, guide beam 62 and control system 64; control system 64 controls carriage 61, and carriage 61 moves back and forth along guide beam 62, during the moving process, printing medium on printing platform 63 is printed by ink droplets ejected from carriage 61 to form the needed images or characters.

Figure 5A:
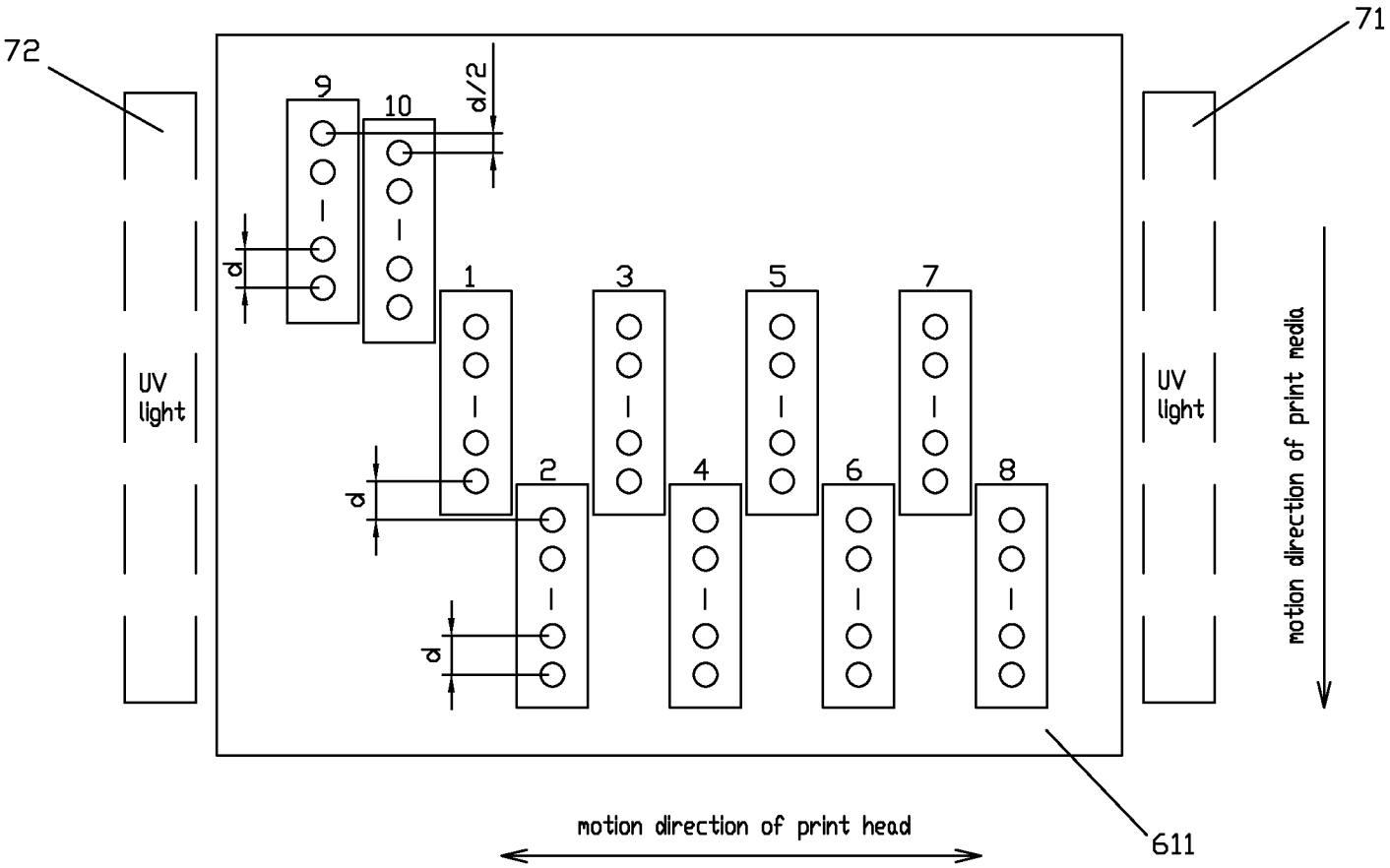
FIG. 5*a* is schematic diagram of inkjet printing apparatus' print heads in the first embodiment of the present invention.

As in FIG. 5*a*, print head baseplate 611 in the present embodiment includes ten same-typed print heads, number of nozzles on each print head is n, distance between two adjacent nozzles within a print head is d, the ten print heads are arranged in two rows, arrangement direction of all the nozzles in the ten print heads are parallel to that of the printing medium's motion direction, and arrangement direction of the ten print heads is same, two print heads eject each specific ink. Print heads 9, 10 eject white (W) ink, print heads 1 and 2 eject cyan (C) ink, print heads 3 and 4 eject magenta (M) ink, print heads 5 and 6 eject yellow (Y) ink, and print heads 7 and 8 eject black (K) ink, print heads 9,10 ejecting white ink are interpolated at the paper inlet end of the inkjet printing apparatus, print heads 1-8 ejecting cyan ink, magenta ink, yellow ink and black ink are arranged side by side at the paper outlet end of the inkjet printing apparatus; along printing medium's motion direction, nozzles of print heads 9, 10 ejecting white ink are not overlapped with nozzles of print heads 1-8 ejecting colored inks. Along print head's motion direction, distances between adjacent print heads are same. Nozzles of print heads ejecting the same colored ink among print heads 1-8 are connected in series, i.e., the last nozzle of print head 1 is connected in series with the first nozzle of print head 2, and such connection pattern is also used between print head 3 and 4, 5 and 6, 7 and 8. Two sets of UV solidification devices 71 and 72 are installed respectively on each side of print head baseplate 611 to solidify ink droplets ejected on the printing medium. Because the two print heads 9, 10 ejecting white ink are interpolated in a row, the width of the print head baseplate 611 is narrowed about the length of print head, consequently, requirements of inkjet printing apparatus on width of UV solidification device is lowered, carriage's weight is reduced and carriage's operating stability in the course of printing is improved.

Figure 5B:
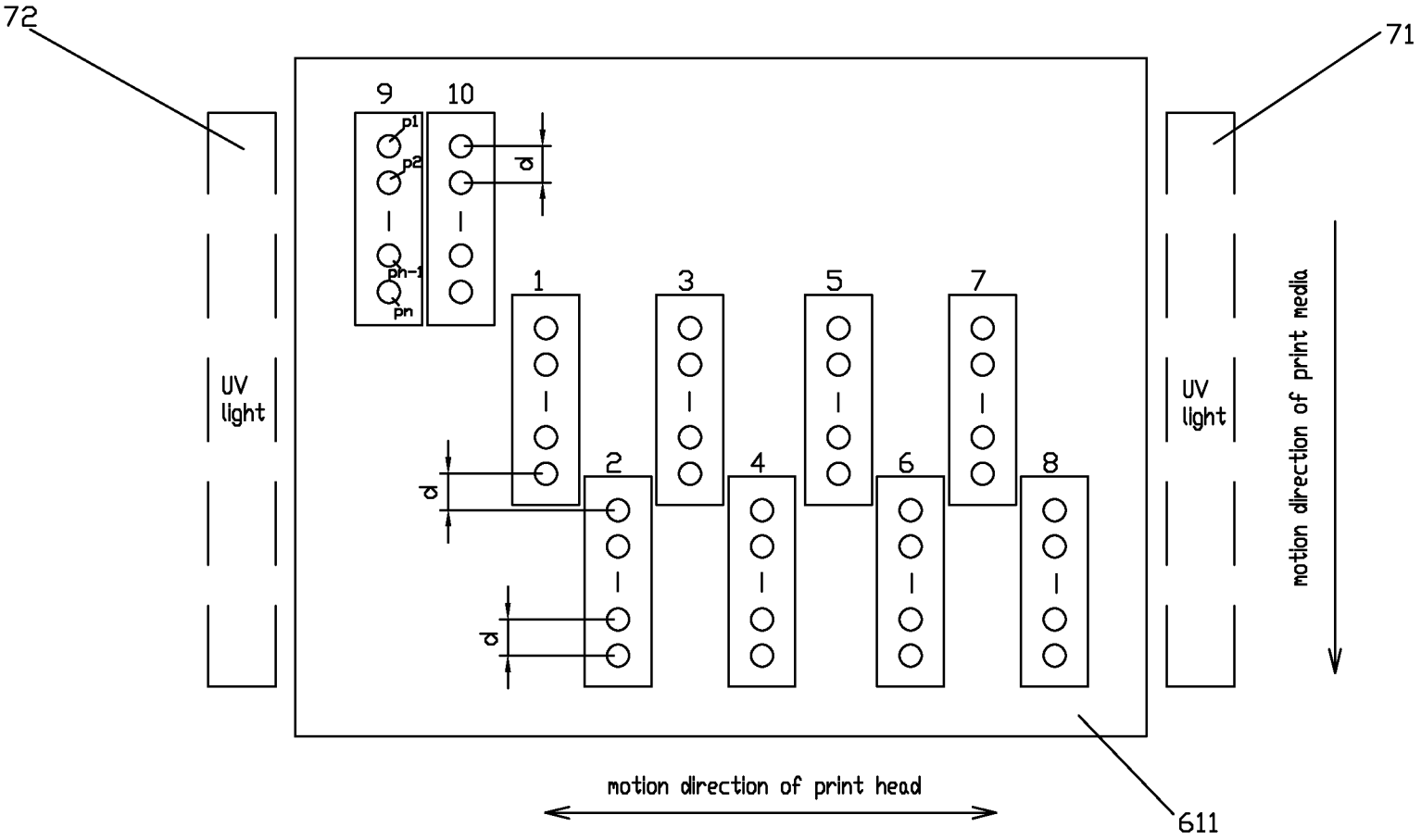
FIG. 5*b* another schematic diagram of inkjet printing apparatus' print heads in the first embodiment of the present invention.

As in FIG. 5*b*, print heads ejecting white ink 9, 10 in the present invention can also be arranged side by side, arrangement of print heads 1-8 ejecting colored inks is the same as that in FIG. 5*a*.

When printing, print heads ejecting white ink 9, 10 firstly print a white backdrop on the printing medium, then ink droplets printed on the printing medium are solidified by UV solidification devices 71 and 72, at last needed colored images are printed on the solidified white backdrop by print heads ejecting colored inks 1-8. One-pass printing pattern is prone to shorten the service life of print heads, and accuracy of the printed images is difficult to be guaranteed. In order to assure printed images' accuracy, multi-pass printing pattern is adopted, while printing output will correspondingly be reduced. In the present embodiment, print heads ejecting white ink 9, 10 employs two-pass printing pattern; when print heads ejecting white ink 9, 10 are interpolated, along printing medium's motion direction, width of nozzle orifice in print heads ejecting white ink 9, 10 is the sum of width of nozzle orifice in a single print head and ½ distance between two nozzle orifices, i.e., nd+d/2; when printing, printing resolution of the white coating layer is two times as many as that of the colored images; when print heads ejecting white ink 9, 10 are arranged side by side, along the printing medium's motion direction, width of nozzle orifice in print heads ejecting white ink 9, 10 is the same as that of nozzle orifice in single print head, i.e., nd; when printing, print head 9 and print head 10 eject respectively an ink droplet, and the two ink droplets are overlapped on the pixel of printed images to form the needed image data. Because every pixel in the white coating layer is printed two times, or its printing resolution is two times as many as that of the colored images, which makes the overall increase of ink in the white coating layer to ensure white ink covers the whole printing area and improve vividness of printed images. Print heads ejecting colored inks 1-8 are arranged in another row, and the two print heads ejecting the same colored ink 1 and 2, 3 and 4, 5 and 6, 7 and 8 are connected in series, total width of nozzle orifice in print heads ejecting colored inks is 2nd; hence, when print heads ejecting ink for coating layer 9, 10 employs two-pass printing pattern, print heads ejecting colored inks 1-8 adopt four-pass printing pattern to improve accuracy of printed images. Therefore, inkjet printing method in the present invention can assure white ink covers the whole printing area and improve accuracy of printed images. According to practical printing demands, in the inkjet printing method of the present invention, print heads ejecting white ink 9, 10 may adopt three-pass pattern, print heads ejecting colored inks 1-8 correspondingly employ six-pass printing pattern. The more the printing times, the higher accuracy of printed images and the lower printing output. Based on practical printing demands, the aforesaid problems can be dealt with by compromise.

The Second Embodiment

Figure 6A:
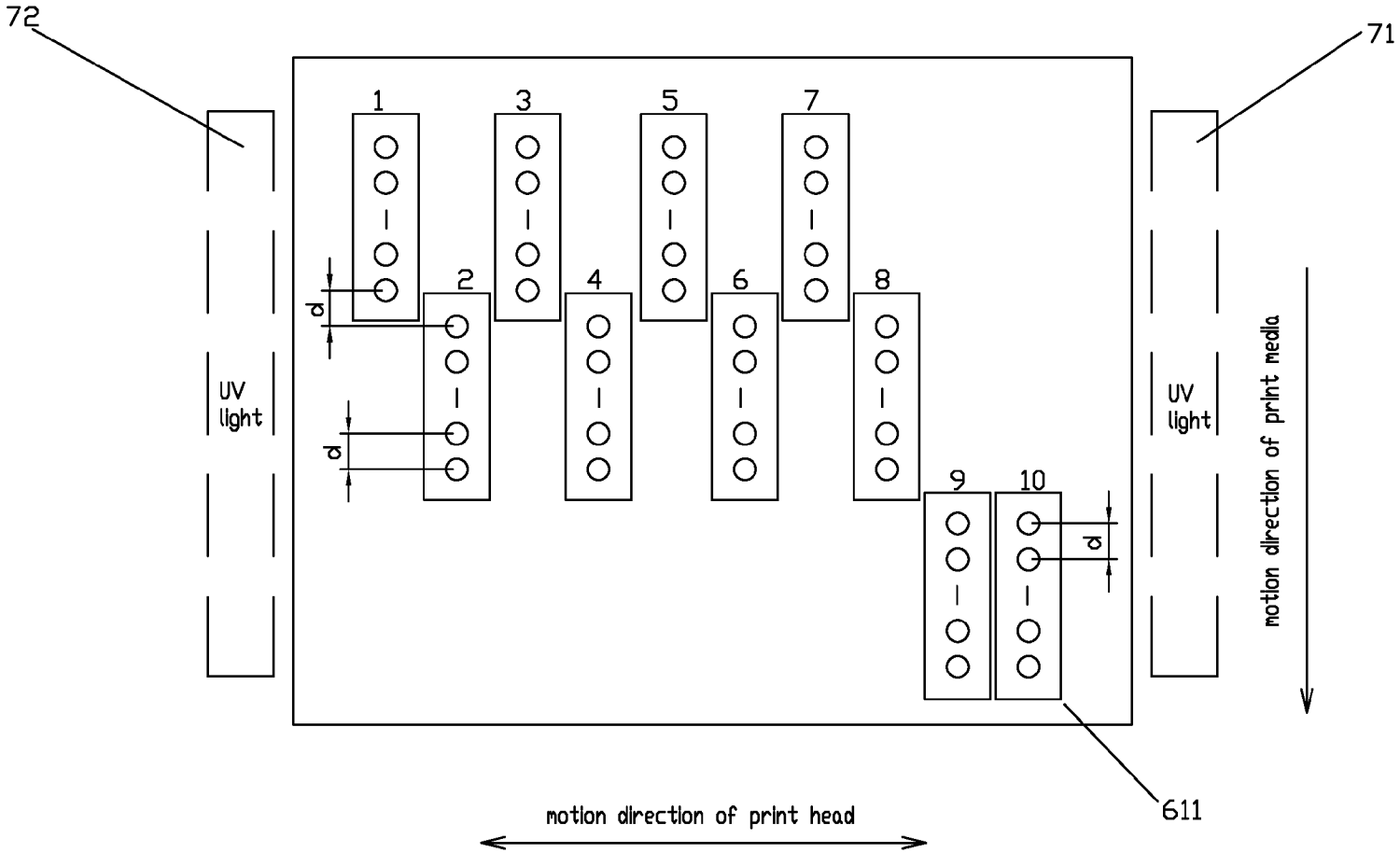
FIG. 6*a* is schematic diagram of inkjet printing apparatus' print heads in the second embodiment of the present invention.

Inkjet printing apparatus and printing method in the present embodiment are employed when colored images are printed on transparent printing medium. When printing images on transparent printing medium such as glass, firstly colored inks are printed on the transparent printing medium to form colored images, then ejecting white ink to cover the colored images, and observers view the printed images by transmitting the transparent medium. As shown in FIG. 6*a*, print head baseplate 611 in the present invention includes ten same-typed print heads; the ten print heads are arranged in two rows, arrangement direction of all the print heads' nozzle orifices is parallel to the motion direction of the printing medium, arrangement directions of all the print heads are same and two print heads eject each specific ink color. Print heads 9, 10 eject white (W) ink, print heads 1, 2 eject cyan (C) ink, print heads 3, 4 eject magenta (M) ink, print heads 5, 6 eject yellow (Y) ink, print heads 7, 8 eject black (K) ink; print heads ejecting white ink 9, 10 are arranged side by side at the paper outlet end of the inkjet printing apparatus, the rest print heads 1-8 ejecting cyan, magenta, yellow and black inks are arranged side by side at the paper inlet end of the inkjet printing apparatus; in two print heads ejecting the same colored ink, the last nozzle of the first print head is connected in series with the first nozzle of the second print head, i.e., the distance between the last nozzle of the first print head and the first nozzle of the second print head is equal to that between two adjacent nozzles within a same print head, the arrangement patterns of print heads 1 and 2, 3 and 4, 5 and 6, 7 and 8 are the same as the foregoing pattern.

Figure 6B:
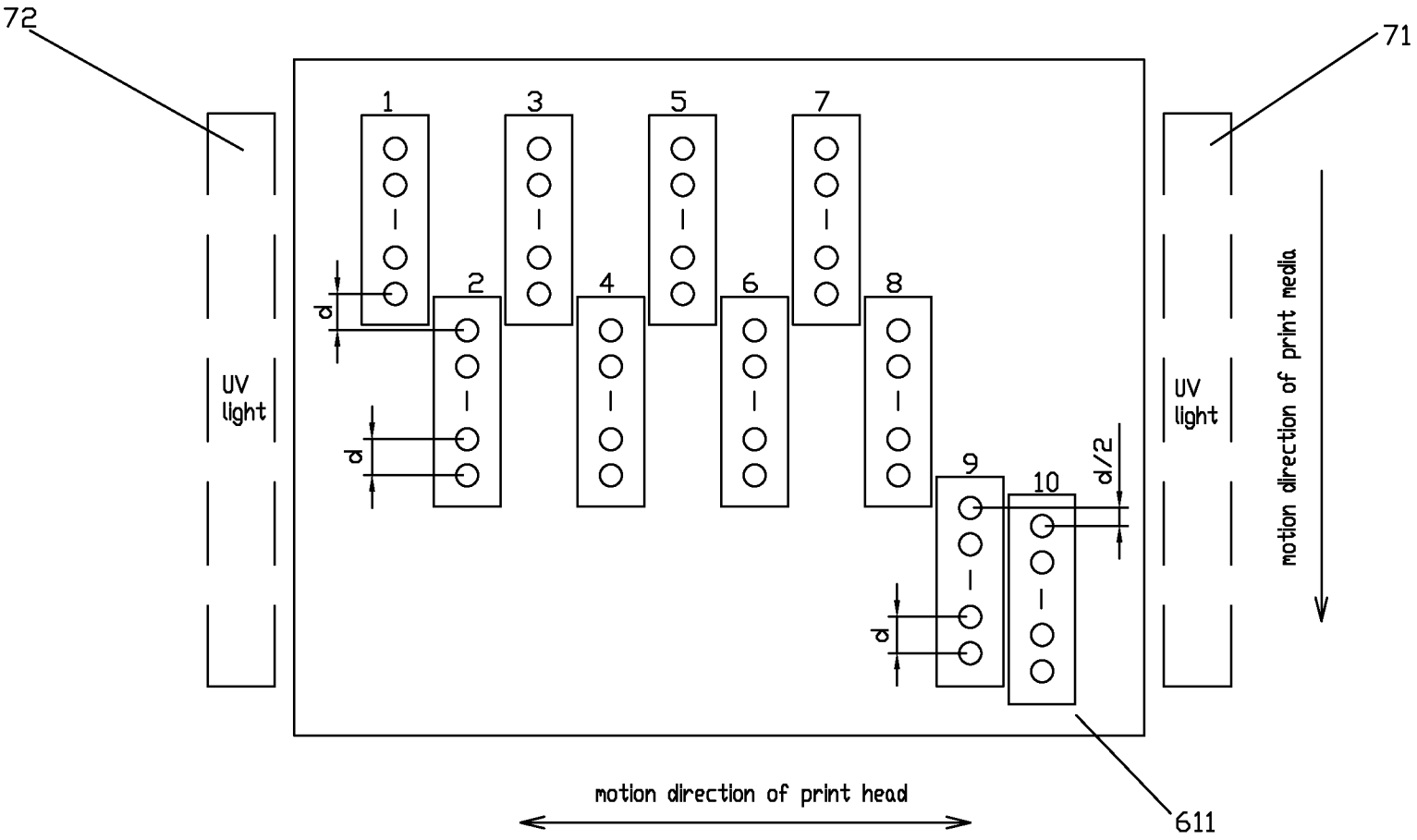
FIG. 6*b* is another schematic diagram of inkjet printing apparatus' printing heads in the second embodiment of the present invention.

As in FIG. 6*b*, print heads ejecting white ink 9, 10 can also be arranged in an interpolation way, meanwhile, arrangement patterns of print heads 1-8 are the same as that in FIG. 6*a*.

When printing, print heads 1-8 firstly print colored images on transparent printing medium, then UV solidification devices 71, 72 solidify the printed images, and at last print heads ejecting white ink 9, 10 eject white ink on the solidified colored images, and observer views the printed images by transmitting the transparent medium; the printing pattern is the same as that of the embodiment, print heads ejecting white ink 9, 10 employ two-pass printing pattern, and print heads ejecting colored inks 1-8 employ four-pass printing pattern.

The Third Embodiment

Figure 7:
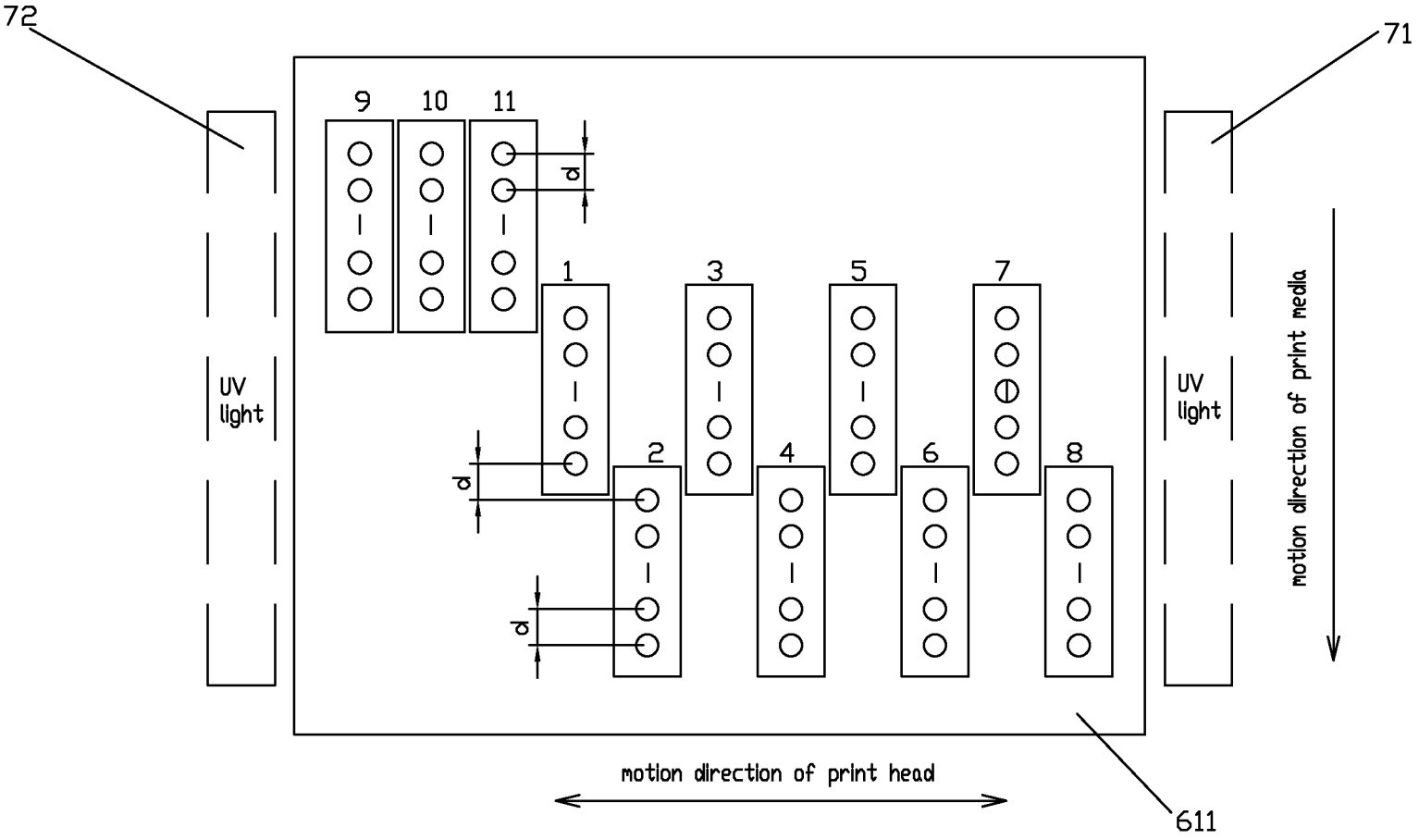
FIG. 7 is schematic diagram of inkjet printing apparatus' print heads in the third embodiment of the present invention.

In the present embodiment, inkjet printing apparatus and printing method are used in printing colored images on non-white printing medium; in order to make white ink cover the whole printing area, several white ink print heads can be interpolated or arranged side by side to raise density of white ink in the printing area, and enhance vividness of printed images. As in FIG. 7, in the present embodiment, three print heads ejecting white ink 9, 10 and 11 are arranged side by side, and they can also be interpolated. Based on practical demands, four or even more print heads ejecting white ink can be interpolated or arranged side by side. Arrangement patterns of print heads ejecting colored inks 1-8 are the same as that in the first embodiment.

In the aforesaid embodiment, in accordance with practical printing demands, print heads ejecting ink for coating layer can also eject transparent ink or other inks used as bottom color inks, such as gray color. In the embodiments of the present invention, no matter which color the ink for coating layer is, arrangement pattern of print head and its printing principle are the same as that of the white ink for coating layer.

In the present invention, print heads ejecting ink for coating layer are interpolated or arranged side by side in a row, and nozzles of print heads ejecting colored inks are connected in series in another row in order to make the whole printing area covered by ink for coating layer, greatly narrow width of print head baseplate, reduce demands on width of UV solidification device, save cost and raise operating stability of the carriage.

Though the present invention has been described with regard to the preferred embodiments, the printing apparatus of the present invention is not limited to the structures of the aforementioned embodiments and printing apparatuses with various modifications and printing apparatuses with various modifications and changes from the aforementioned embodiment are also included in the present invention. It is therefore to be understood that, within the scope of the appended claims, the invention may be practiced otherwise than as specifically described herein.

What is claimed is:

1. An inkjet printing apparatus that includes same-typed print heads, among which at least two print heads eject ink for a coating layer and the rest eject colored inks, wherein print heads ejecting ink for the coating layer are arranged in a row, and print heads ejecting ink for colored inks are arranged in the other two rows;

print heads ejecting colored inks include heads that eject the same colored ink and heads that eject different colored inks;

every two print heads are used to print the same colored ink;

the print heads ejecting ink for the coating layer are interpolated or arranged abreast;

along a printing media's motion direction, print heads ejecting the same colored ink are connected in series with a distance between the last nozzle of a print head and the first nozzle of another following the former one being the same as that between two nozzles within a print head, while print heads ejecting different colored inks are arranged abreast;

all print heads are placed at the origin of media feeding with head nozzle lines arranged in the direction that is parallel with the media motion direction;

a UV solidification device is installed to the left and right of the same-typed print heads; and the total width of print heads ejecting ink for coating layer and print heads ejecting colored inks is smaller than the curing width of the device.

2. The inkjet printing apparatus according to claim 1, wherein; the ink for coating layer is white ink.

3. The inkjet printing apparatus according to claim 1, wherein; the ink for coating layer is transparent ink.

4. The inkjet printing apparatus according to claim 1, wherein the quantity of print heads ejecting ink for coating layer and the quantity of print heads ejecting the same colored ink can be the same or different:

a) two print heads eject ink for coating layer and every two of the rest print heads eject the same colored ink;

b) three print heads eject ink for coating layer and every two of the rest print heads eject the same colored ink.

5. The inkjet printing apparatus according to claim 1, wherein the quantities of print heads ejecting every colored ink are the same.

* * * * *